US005597144A

United States Patent [19]

Lee

[11] Patent Number: 5,597,144

[45] Date of Patent: Jan. 28, 1997

[54] GOLF BAG STAND

[76] Inventor: Soeng-Yeol Lee, 1061-47, Daejeo-1Dong, Kangseo-Ku, Pusan, Rep. of Korea

[21] Appl. No.: 353,219

[22] Filed: Dec. 14, 1994

[30] Foreign Application Priority Data

Dec. 14, 1993 [KR] Rep. of Korea ..... 93-27606

[51] Int. Cl.[6] ..... A63B 55/00

[52] U.S. Cl. ..... 248/96; 248/169; 248/688

[58] Field of Search ..... 248/96, 168, 169, 248/688; 206/315.8, 315.7

[56] References Cited

U.S. PATENT DOCUMENTS 1,686,774 10/1928 Sperry ..... 248/96
5,154,377 10/1992 Suk ..... 248/96
5,156,366 10/1992 Anderson ..... 248/169
5,314,150 5/1994 Seop ..... 206/315.7
5,340,063 8/1994 Hsieh ..... 248/96
5,351,921 10/1994 Chen ..... 248/688
5,407,155 4/1995 Chung ..... 248/168
5,415,285 5/1995 Reimers ..... 248/96
5,464,180 11/1995 Cheng ..... 206/315.7

*Primary Examiner*—Karen J. Chotkowski
*Assistant Examiner*—Gwendolyn Wrenn
*Attorney, Agent, or Firm*—Birch, Stewart, Kolasch & Birch, LLP

[57] ABSTRACT

A golf bag stand which can support a golf bag carrying golf equipment in an inclined position while it is at rest. A hinge block comprising a pair of T-shaped holes firmly holds support rods inserted therein. The support rods are unfolded in the form of a tripod and are firmly held within said holes so as to bear the heavy weight of the golf bag. A V-shaped connecting rod and a resilient means are provided for serving to spread the supporting rods when in use and for pulling them into a carrying position.

2 Claims, 5 Drawing Sheets

GOLF BAG STAND

BACKGROUND OF THE INVENTION

1. Field of the Invention

The present invention relates to a golf bag stand which can support a golf bag in an inclined position while it is at rest.

2. Prior Art

A variety of golf bag stands are described in the prior art. Golf bag stands have been provided with legs in the form of a tripod which can support the golf bag which contains golf clubs, golf balls, and other related equipment used to play the game. Preferably the golf bag is placed in an inclined position for guaranteeing stability and provide easiness in storing equipment used in the game. The present invention is an improvement in this type of golf bag stand.

Referring to FIG. 7, there is shown a perspective view of this type of golf bag stand which is placed on the terrain, the bag being omitted for clarity. The golf bag stand comprises a hinge body 1 having an integrally formed attachment plate 2 which is secured to the upper end of the bag, a pair of frontal legs 4 which are pivotally attached to each side of the hinge body 1 through a protruding stem 3 provided in the upper end thereof. A back leg 5 has an upper end inserted into the center of the hinge body 1 and a lower end pivotally secured to an attachment plate 6, having an L-shaped cross section. A slanted face 7 is provided at the upper end of the respective frontal legs 4, where it is in close contact with the attachment plate 2 for supporting the plate 2. A pair of enforcement rods 8 extend between the attachment plate 2 and the middle of the legs 4 to prevent the legs 4 from breaking down due to an excessive heavy weight of the bag. A spring 9 is mounted around the upper end of the back leg 5, and a pair of connecting rods 10 are provided with an upper end pivotally attached to the upper end of each frontal leg 4 and a low end pivotally attached to the attachment plate 6, whereby the frontal legs 4 are unfolded to support the bag in an inclined position.

The above described conventional golf bag stand has the following shortcomings, (a) the protruding stems 3, which are provided at the top of the frontal legs 4 and adapted to be inserted into each side of the hinge body 1, are readily detached by a mere snapping action to collapse the stand unit.

(b) the frontal legs 4 and the back leg 5, which are unfolded in the form of a tripod to support the bag, readily collapse due to excessive heavy weight of the bag.

(c) to avoid the drawback (b), a pair of enforcement rods 8 is extended between the attachment plate 2 and the legs 4 to prevent the legs 4 from breaking down due to the excessive heavy weight of the bag. However, it requires considerable time and cost in assembly.

(d) since the spring 9, mounted around the upper end of the back leg 5, is exposed to the air, it is easily soiled with dirt or the like which adversely effects not only the appearance of the stand unit but also.

(e) the sharp corner of the upper end of the back leg 5, which is upwardly protruded from the upper surface of the hinge body 1, may cause scratches on the outer surface of the golf bag.

The present invention avoids the aforementioned drawbacks and provides a novel and superior golf bag stand.

SUMMARY OF THE INVENTION

According to the present invention, the golf bag stand comprise a hinge block adapted to be mounted to said bag and to accommodate the upper end of a pair of vertical support rods, said hinge block including a lower half member having an attachment flange integrally formed therein for rigidly mounting said lower half member to the upper end of the bag and an upper half member engaged to said lower half member to form said complete hinge block. Each of said lower and upper half members has a T-shaped groove between their contact surface having respective semi-circular cross sections pair of vertical support rods are pivotally attached to said hinge block through a T-shaped member provided at topmost end thereof and movable from an unfolding position to a folding position. The rods are unfolded to support said bag in an inclined position and are folded to the outer surface of said bag in a substantially upright position. A hinge means is pivotally attached to the lower end of said bag, said hinge means having an attachment plate rigidly secured to said lower end of the bag and a pivot plate pivotally movable against said attachment plate. A resilient means is adapted to be mounted on said hinge means. A hollow tube is secured to said pivot plate at the lower end thereof. A retainer means is adapted to receive an upper end of said hollow tube and secured onto said bag and a shaft is inserted within said hollow tube and secured to a bottom of said hollow tube at the lower end thereof. The shaft is movable between an upward position against the bias of a spring mounted around said shaft and a normal downward position by said spring bias. A V-shaped connecting rod extended between said T-shaped member and an upper end of said shaft to unfold said support rods when the bag is in its substantially upright position.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENT

Figure 1:
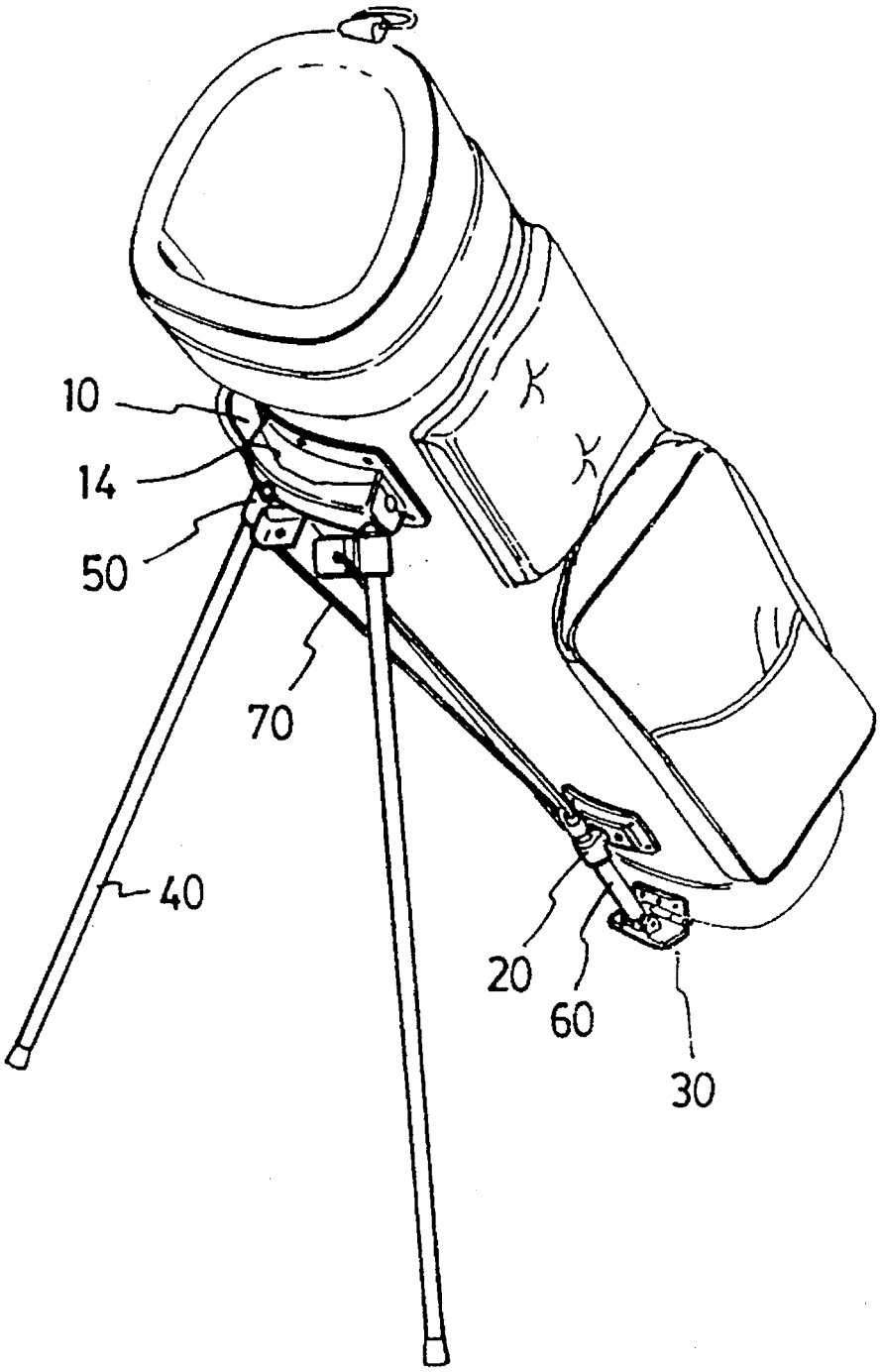
FIG. 1 is a perspective view of the present invention in an operational position.
Figure 2:
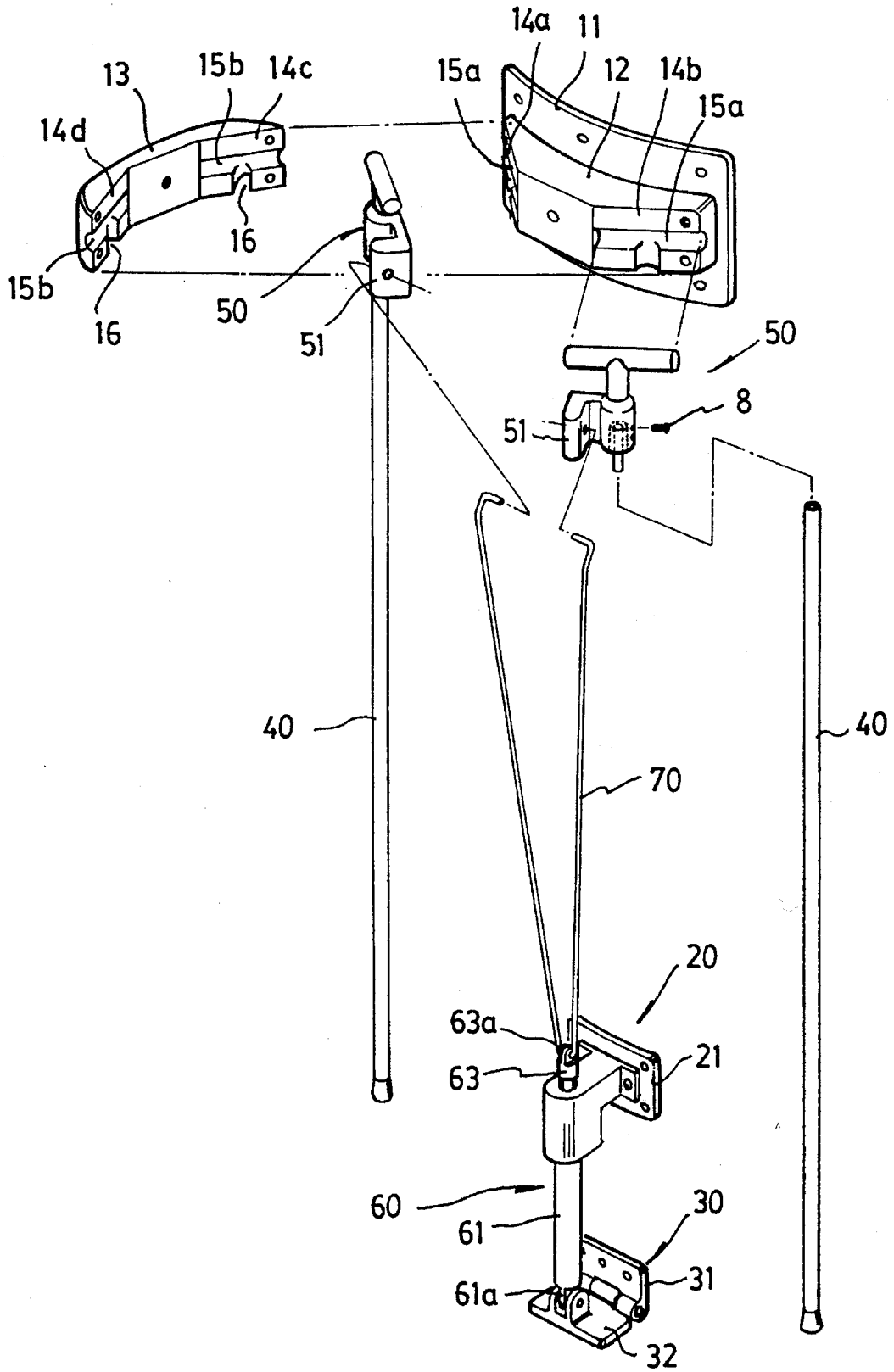
FIG. 2 is an exploded view of the present invention.
Figure 3:
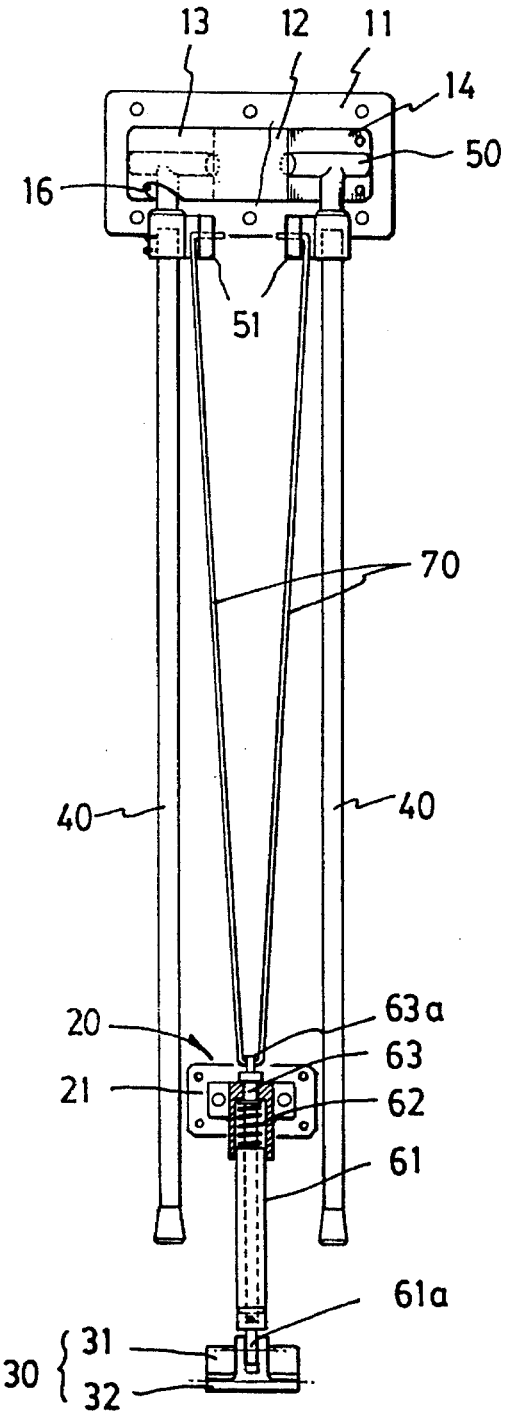
FIG. 3 is a front elevation of the present invention with the golf bag omitted for clarity.

Referring now FIGS. 1–3, the golf bag stand shown therein comprises a hinge block 10 attached to the upper end of the bag 1 by an attachment flange 11 in the form of a flat rectangular panel which is integrally formed therearound. The hinge block 10 consists of a lower half member 12 and an upper half member 13 which are engaged to form a complete hinge block. The lower half member 12 shown in FIG. 2 is in the form of a convex panel including two slanted surfaces **14*a* and 14*b* on each side. As shown in FIG. 2, said upper half member 13 is in the form of a concave panel including two slanted surfaces 14*c* and 14*d*** on each side.

Figure 4:
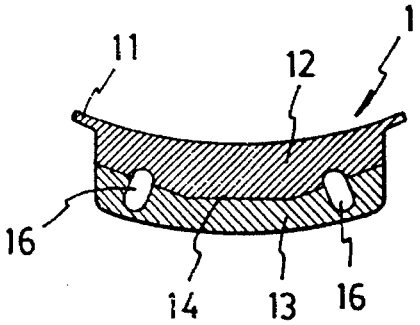
FIG. 4 is a sectional plan view of a hinge block according to the present invention.

At each slanted surfaces 14*a*, 14*b*, 14*c* and 14*d* there is provided a T-shaped groove 15*a* and 15*b* having respective semi-circular cross sections. Said T-shaped grooves 15*a* and 15*b* when engaged form T-shaped holes, adapted to receive a pair of support rods, which are well depicted in FIG. 4. The holes are flared outwardly to permit said support rods, when inserted therein, to be unfolded in the form of a tripod whereby the T-shaped member 50 which is inserted into the T-shaped holes 16 for securing the topmost of said support rods 40 can be moved from a folded position to an unfolded position in the form of a tripod. The support rods are firmly held in said holes so as to bear the heavy weight of the golf bag.

Near the lower end of the bag 1 a retainer means 20 is attached by which a resilient means 60 can be secured onto the bag 1, described in greater detail below.

Figure 5:
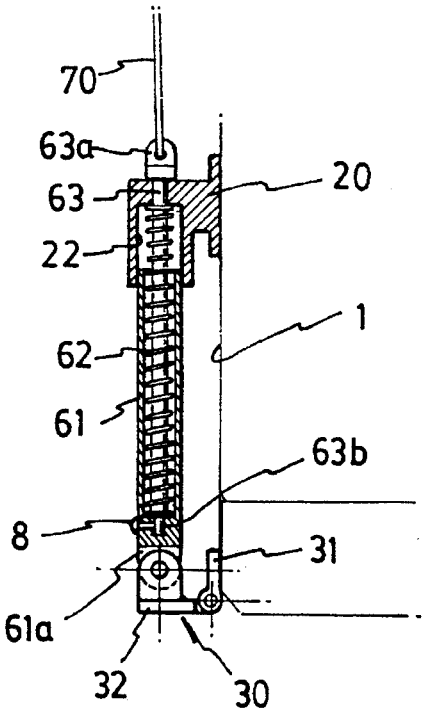
FIG. 5 is an enlarged sectional view of a resilient means according to the invention.
Figure 6:
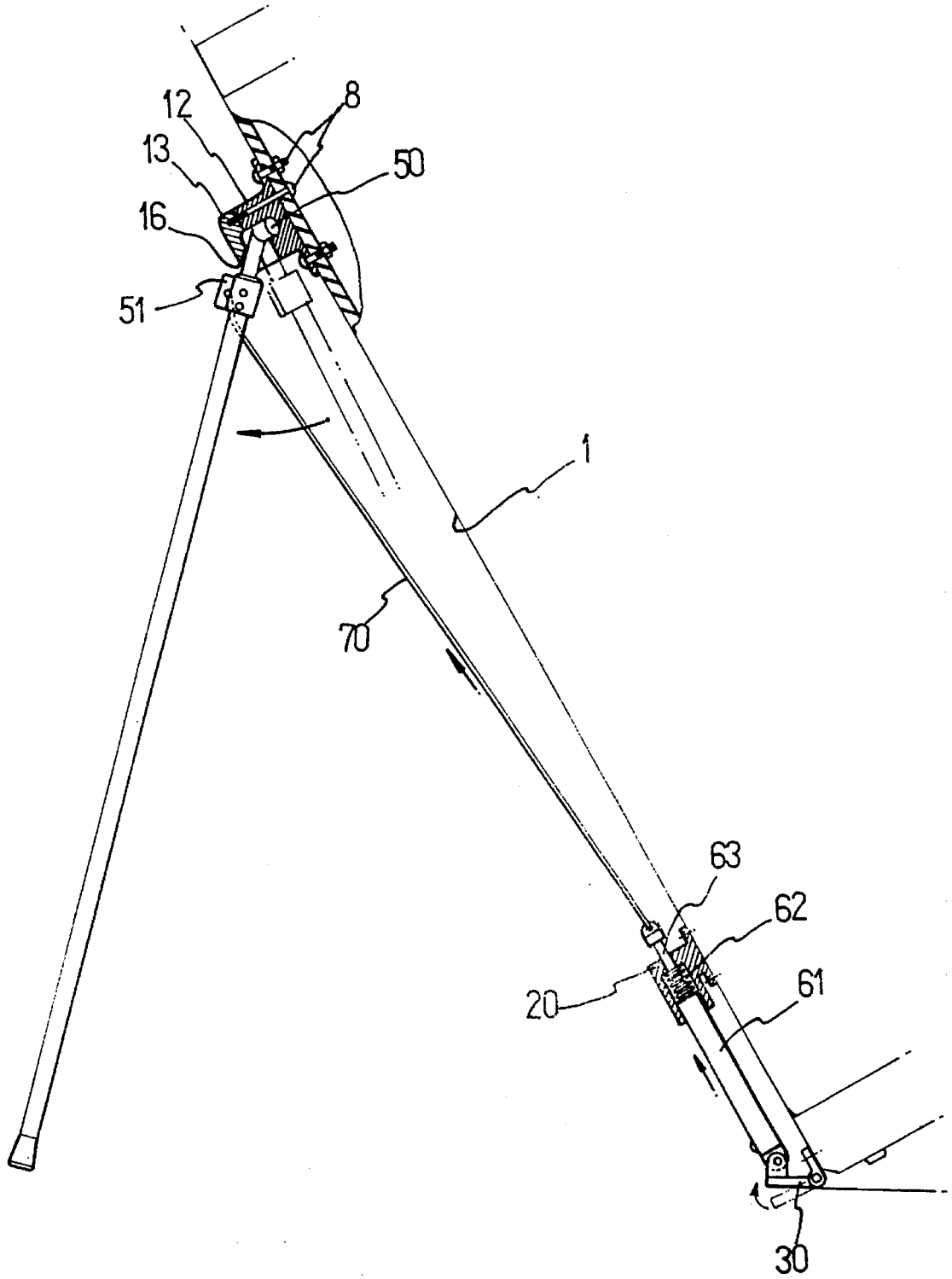
FIG. 6 is a side elevational view, partially in cross section, of the present invention in an operational position.
Figure 7:
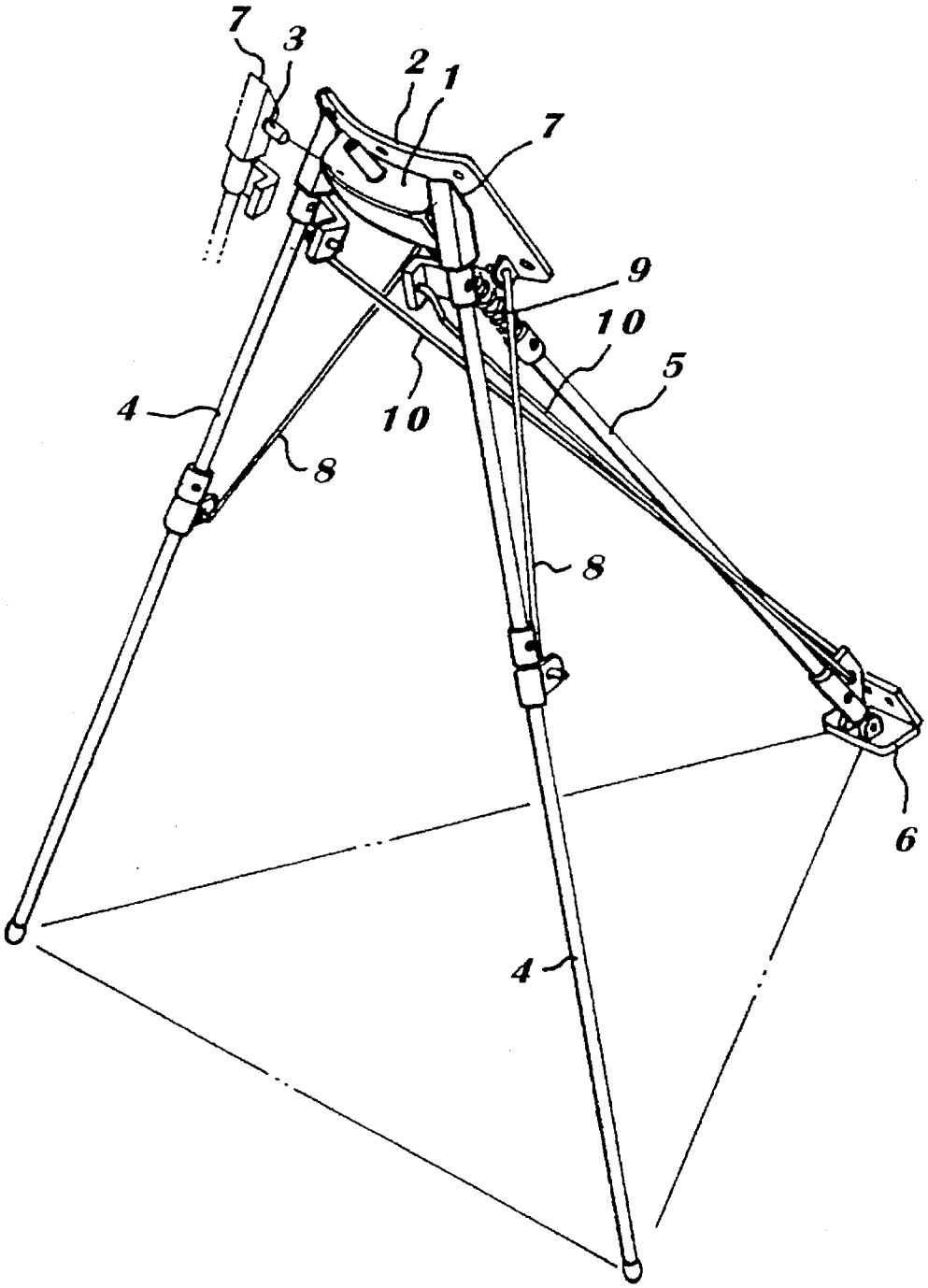
FIG 7 BACKGROUND ART
FIG. 7 is a perspective view of the prior art in an operational position.

Referring now to FIG. 5, there is shown an enlarged sectional view of the resilient means 60 according to the present invention. The resilient means 60 is engaged within a hole 22 which is provided in the retainer means 20 so as to receive the upper end of said hollow tube 61. The retainer means 20 is secured onto the outer surface of the bag 1. The hollow tube 61 is secured to a pivot plate 32 at the lower end 61*a* thereof. There is provided a shaft 63 which is inserted within the hollow tube 61. The shaft is secured to the bottom of said hollow tube 61 at the lower end 63*b* thereof by a set screw 8. The shaft 63 is movable between an upward position against the bias of spring 62, mounted around said shaft 63, and a normal downward position by said spring bias 62.

Under said retainer means 20 a hinge means 30 is shown which comprises an attachment plate 31 rigidly secured to said lower end of the bag 1 and a pivot plate 32 pivotally movable against said attachment plate 31.

Referring to FIG. 3, a V-shaped connecting rod 70 is extended between said T-shaped member 50, which is inserted within said T-shaped holes 16, and an upper end 63*a* of said shaft 63 for unfolding said support rods 40 when the bag is placed on a ground and takes an inclined position. When the bag 1 is lifted from the ground, the V-shaped connecting rod 70 is pulled down to bag 1 by the traction of said resilient means 60 and also by its own weight. On the other hand, when the bag 1 is placed on the ground, the base plate 32 which is pivotally attached to the attachment plate 31 is upwardly rotated to push the hollow tube 61 and also the shaft 63 against the attraction of the bias spring 62. The V-shaped connecting rod then pushes the extensions 51, which are integrally formed in said T-shaped member 50 and connected to the upper end of the V-shaped connecting rod 70 respectively, to unfold the vertical support rods 40 in the form of tripod.

It will be apparent that various changes and modifications in the illustrative embodiment of the invention, shown and described herein, can be made without departing from the scope of the invention as defined in the appended claims.

What is claimed is:

1. A golf bag stand, comprising:

a hinge block adapted to be mounted to said bag and to accommodate upper ends of a pair of vertical support rods, said hinge block including a lower half member having an attachment flange integrally formed therein for rigidly mounting said lower half member to the upper end of the bag and a upper half member engaged to said lower half member to form said complete hinge block in which each of said upper and lower half members have opposing T-shaped grooves between their contact surface of semi-circular cross section;

a pair of vertical support rods pivotally attached to said hinge block through a T-shaped member provided at a topmost end thereof and movable from an unfolding position to a folding position, said rods being unfolded to support said bag in an inclined position and being folded to be held against the outer surface of said bag in a substantially upright position;

a hinge means pivotally attached to a lower end of said bag, said hinge means having an attachment plate rigidly secured to said lower end of the bag and a pivot plate pivotally movable against said attachment plate;

a resilient means, adapted to be mounted on said hinge means, including a hollow tube secured to said pivot plate at the lower end thereof, a retainer means adapted to receive an upper end of said hollow tube and to be secured onto said bag, and a shaft inserted within said hollow tube and secured to a bottom of said hollow tube at the lower end thereof, the shaft being movable between an upward position against a bias of the spring mounted around said shaft and a normal downward position by said spring bias; and a V-shaped connecting rod extending between said T-shaped member and an upper end of said shaft to unfold said support rods when the bag is in its substantially upright position.

2. The gold bag stand as defined in claim 1 wherein said lower half member is in the form of a convex panel including two slanted surfaces on each side, and said upper half member is in the form of a concave panel including two slanted surfaces on each side, said slanted surfaces including T-shaped grooves having semi-circular cross sections so that opposing T-shaped grooves engage to form T-shaped holes adapted to receive a pair of support rods, wherein the holes are flared outwardly to permit said support rods to be unfolded in the form of a tripod.

* * * * *